US008453484B2

(12) United States Patent
Beigang

(10) Patent No.: US 8,453,484 B2
(45) Date of Patent: Jun. 4, 2013

(54) MANUFACTURE OF A SHAFT/HUB CONNECTION

(75) Inventor: Wolfgang Beigang, Ruppichteroth (DE)

(73) Assignee: GKN Driveline International GmbH, Lohmar (DE)

( * ) Notice: Subject to any disclaimer, the term of this patent is extended or adjusted under 35 U.S.C. 154(b) by 1366 days.

(21) Appl. No.: 11/996,500

(22) PCT Filed: Jul. 21, 2005

(86) PCT No.: PCT/EP2005/007940

§ 371 (c)(1),
(2), (4) Date: Jan. 22, 2008

(87) PCT Pub. No.: WO2007/009476

PCT Pub. Date: Jan. 25, 2007

(65) Prior Publication Data

US 2008/0201950 A1 Aug. 28, 2008

(51) Int. Cl.
*B21H 1/18* (2006.01)

(52) U.S. Cl.
USPC ..... 72/108; 72/89; 72/88; 72/469; 29/893.32

(58) Field of Classification Search
USPC ..... 29/893, 893.3–893.37; 72/108, 88, 72/89, 469
See application file for complete search history.

(56) References Cited

U.S. PATENT DOCUMENTS

| | | | | |
|---|---|---|---|---|
| 3,813,909 | A * | 6/1974 | Roger | 72/95 |
| 3,982,415 | A * | 9/1976 | Killop | 72/88 |
| 4,485,657 | A * | 12/1984 | Ridley et al. | 72/88 |
| 4,506,537 | A * | 3/1985 | Anderson | 72/469 |
| 4,610,154 | A * | 9/1986 | Carene, Jr. | 72/88 |
| 4,716,751 | A * | 1/1988 | Wozniak | 72/88 |
| 4,876,876 | A | 10/1989 | Ishida et al. | |
| 5,507,167 | A | 4/1996 | Statezni et al. | |
| 5,829,911 | A | 11/1998 | Yokota et al. | |
| 6,142,033 | A | 11/2000 | Beigang | |
| 6,233,999 | B1 | 5/2001 | Yabutani et al. | |
| 6,250,123 | B1 * | 6/2001 | Killop | 72/88 |
| 6,279,366 | B1 * | 8/2001 | Sakaguchi | 72/102 |

(Continued)

FOREIGN PATENT DOCUMENTS

| | | |
|---|---|---|
| DE | 43 13 712 A | 4/1993 |
| DE | 43 02 726 A1 | 8/1993 |

(Continued)

OTHER PUBLICATIONS

Office Action dated Jan. 9, 2008 for German Application No. 11 2005 003 630.8-14.

(Continued)

*Primary Examiner* — Sarang Afzali
(74) *Attorney, Agent, or Firm* — Rader, Fishman & Grauer PLLC

(57) ABSTRACT

A method for manufacturing a toothing on a component of a shaft/hub connection is disclosed. The component may be held permanently in a chucking while it receives an at least two-stage toothing in this chucking. A special draw die for carrying out the method is also proposed, a first toothing-forming region with a first height and at least one following second toothing-forming region with at least one second height being arranged between a first and a second end face, and the first height being designed to be lower than the second height.

8 Claims, 7 Drawing Sheets

U.S. PATENT DOCUMENTS

| | | | | |
|---|---|---|---|---|
| 6,598,453 | B2 * | 7/2003 | Murai et al. | 72/469 |
| 7,040,131 | B2 * | 5/2006 | Monot | 72/102 |
| 7,972,078 | B2 | 7/2011 | Igarashi et al. | |

FOREIGN PATENT DOCUMENTS

| | | | |
|---|---|---|---|
| DE | 43 06 742 | A1 | 9/1994 |
| DE | 197 22 917 | C1 | 5/1997 |
| DE | 199 29 639 | A1 | 2/2001 |
| DE | 102 12 256 | A1 | 5/2003 |
| EP | 1 653 099 | A1 | 5/2006 |
| FR | 2178741 | | 11/1973 |

OTHER PUBLICATIONS

PCT International Search Report for PCT/EP2005/007940 dated Apr. 6, 2006.

* cited by examiner

MANUFACTURE OF A SHAFT/HUB CONNECTION

TECHNICAL FIELD

The present invention relates to a method utilizing a draw die and a toothing rolling tool for making a toothing on a component of a shaft/hub connection and also to a component of a shaft/hub connection.

BACKGROUND

It is known that shaft/hub units have a toothing. This may be seen, for example, from U.S. Pat. No. 6,142,033. The toothing is in this case coordinated such that as high torque transmission as possible is allowed. For this purpose, a toothing on a shaft shank is adapted to a toothing of a hub, and vice versa.

SUMMARY OF THE INVENTION

The present invention provides a method to improve the force transmission of a shaft/hub connection and the quality of an associated toothing, while, in particular, manufacture is additionally to be simplified.

The method for manufacturing a toothing on a component of a shaft/hub connection provides for holding the component permanently in a chucking while it receives an at least two-stage toothing in this chucking. It may thereby be possible to avoid machining errors which arise due to changes in the chucking between two work steps. In addition, the permanent chucking of the component during the manufacture of the toothing preferably makes it possible to have a single-stage operation so that the at least two-stage toothing can be manufactured. For example, there is provision for the at least two-stage toothing to be capable of being manufactured by means of a single tool. The tool has the machining surfaces necessary in each case for the toothing to be manufactured. These machining surfaces are arranged, in particular, separately from one another along the tool. In particular, the arrangement is such that, along a tool machining direction, an engagement of the individual machining surfaces can take place separately from one another in one machining pass in various regions of the component. For this purpose, there is preferably provision for a translational relative movement between the component and tool to be executed. There may also be a provision for the tool and component to execute a rotational movement in relation to one another. There may be a provision for preferably a pair of roller beams to be moved in translation in relation to one another and for a rotatably mounted shaft arranged between them to execute a rotational movement while a multistep toothing is being applied.

According to a development, an at least two-stage external toothing is manufactured on the component. For this purpose, in particular, the component is held in a chucking, so that it can be guided, for example, through a draw die which is permanently arranged fixedly during the manufacture of the toothing. For example, during the manufacture of the external toothing, a hollow component is used, so that a chucking of the component can also take place in an interior of the component. Furthermore, there is the possibility that chucking takes place in an outer region of the component which does not come into engagement with a toothing tool. For this purpose, the component may have, for example, one or more chucking surfaces. According to a development, there is provision for a projecting edge to be provided for chucking. This projecting edge allows an, in particular, uniform force distribution during chucking and a defined form fit between the component in the chucking and a chucking holder itself. A component of a shaft/hub connection may be provided simultaneously in one chucking with a plurality of toothings. For this purpose, for example, a shaft with toothings on both ends may be provided. However, at least one shaft region arranged between ends lying opposite one another may also be provided with a multistage toothing. Also, three or more multistage toothings may be manufactured. For example, a simultaneous manufacture of toothings on shafts may be gathered from U.S. Pat. No. 6,142,033 and from FR 2 178 741, to which reference is made in this respect within the framework of the disclosure. There is also the possibility of also manufacturing at least one same-stage toothing in addition to a simultaneous manufacture of external toothings and/or internal toothings on the shaft and/or hub as a multistage toothing. This may take place either separately or simultaneously with the manufacture of the multistage toothing.

There may be a provision for at least one two-stage internal toothing to be manufactured on the component. In this case, for example, the component may be held in the chucking on an outer surface. The component itself has a hollow region. This hollow region is brought into engagement with the toothing tool. This preferably takes place via a translation movement. However, there is likewise the possibility of executing a rotating movement between the component and the toothing tool.

It has proved to be advantageous if an addition of lubricant takes place during the manufacture of the at least two-stage toothing. Lubricant addition may take place, for example, before the actual manufacture of the two-stage toothing onto the surface of the toothing tool and/or onto the surface of the component to be machined. Furthermore, there is the possibility of providing a metering of the lubricant addition. Moreover, there is the possibility that a special quantity can be applied, in particular, even in a special region of the toothing tool. Furthermore, there is the possibility of providing a continuous or even discontinuous lubricant addition. The lubricant itself may be added as an emulsion or in the form of an oil. Addition may take place as a fluid stream. There is likewise the possibility, however, of spraying on the lubricant or of supplying it in another way. There is preferably provision for the lubricant used to be water-soluble. This makes it possible to clean the tool or the component by means of water.

According to one idea of the invention, a draw die is used for carrying out a method for manufacturing a toothing on a component of a shaft/hub connection, in which the component is held permanently in a chucking, while it receives an at least two-stage toothing in this chucking. The draw die has a first and an opposite second end face. Between the first and the second end faces are arranged a first toothing-forming region with a first height and at least one following second toothing-forming region with at least one second height. The first height is in this case designed to be lower than the second height. Thus, according to a first refinement, by the component being introduced into the draw die on the first end face, initially the first height can be brought into contact with the component, and, during a further introduction of the component into the draw die, this first contact region of the component subsequently comes into contact with the second height of the toothing-forming region of the draw die. What is thus achieved by the first height is that a material displacement as far as a first region takes place. A further displacement takes place in the region of the first displacement due to the second height. This second height can then be followed by a third and a further height which in each case are preferably greater than the in each case preceding height of the respective toothing-forming region of the draw die.

According to a refinement, between at least the first and the second height there is a region of the toothing-forming portion of the draw die which has a height which is lower than the first and the second height. Preferably, this region is designed in such a way that the displaced material of the component experiences some stress relief before it undergoes, as a result of the engagement of the second toothing-forming region, a second displacement going beyond the first displacement. Owing to this measure, friction in the draw die and consequently a forming force to be applied are reduced. Furthermore, the regions of lower height form lubricant reservoirs which, before the second forming stage, once more deliver lubricant onto the component surface and thus increase the useful life of the tools, in particular the draw dies.

According to a further refinement, the draw die has a first toothing-forming region with the first height, in respect of which at least one second toothing-forming region with at least one second height is arranged so as to be offset not only in the translational direction, but also in a circumferential direction of the draw die. Thus, the component which has penetrated into the first end face can, in turn, initially come into contact with the first toothing-forming region. By contrast, the subsequently arranged second toothing-forming region is not arranged directly behind the first toothing-forming region along a translational movement, but, instead, so as to be offset with respect to this. A different toothing can thereby be executed on the component in one operation by means of the draw die. In particular, in the case of an offset of the first and of the second toothing-forming region, there is the possibility that different toothing modules could be provided.

The draw die may be geared to making an at least two-stage toothing formation possible on a component in a single operation. For this purpose, according to a refinement, the component may be introduced completely or at least partially on the first end face of the draw die. Subsequently, after the first and the second toothing region have been applied to the component, the latter is preferably guided back out again, without the chucking of the component having to be changed for this purpose. Should it be necessary for the component to be introduced once again, the chucking need not be changed for this purpose. There may be a provision for the draw die to be arranged in a fixture which, in turn, is connected to a chucking for the component. The chucking is moved along a predetermined track guide which is ensured, in particular, via a slide guide or the like. Manufacture with high accuracies can thereby be carried out. There is preferably provision for the manufactured component with at least two-stage toothing to have reached, after the execution of the manufacture of the toothing via the draw die, a final configuration which does not have to be machined further in order to achieve dimensional accuracy. This final configuration preferably has a quality at least of tolerance class 6 or, better, according to standard ANSI B29.1 or DIN 3962.

According to a further improvement, there is provision for the draw die to contain, at least in one region, a virtually infinite number of small steps, the envelope of which lies within a flat angle of between one degree and ten degrees. The draw die in this case has the toothing-forming region as a line-up of a multiplicity of small steps. However, one or more elongate regions of lower height may be arranged between these steps. The material of the introduced component can experience stress relief in these regions.

Preferably, material-displacing gradients of the toothing-forming regions have an angle between 5° and 30°. If a plurality of such angles are arranged one behind the other, these may be identical or may even deviate in each case from one another.

Furthermore, there is provision for the draw die to have the toothing-forming region on an outer region instead of in an inner surface which is formed via a longitudinal orifice between the first and the second end face.

Preferably, an internal toothing of the component is manufactured by means of a mandrel. The mandrel may be introduced into the hollow region of the component or else the hollow part of the component is applied to the mandrel. In this case, there is the possibility that a travel of the mandrel runs perpendicularly in a vertical. The component with its hollow region is then slipped onto the mandrel from above, the applied pressure force being applied via the chucking. The mandrel is secured by being supported preferably on a bottom region, to an extent such that a corresponding counter force to the pressure force is generated, a material displacement for generating the toothing being carried out via the toothing-forming regions along the mandrel. However, reverse kinematics are also possible. According to a development, the mandrel has a nonround, for example angular, geometry. The nonround geometry in this case relates to a basic shape of a mandrel cross section. This basic shape may be rectangular, square, polyangular and/or oval, elliptic or polygonal.

In order to simplify an introduction of the mandrel and component or component and draw die, there may be a provision for a centering region to be arranged in front of the toothing in the forming direction. This centering region preferably allows the alignment of the component during introduction into the draw die or during the reverse relative movement. In particular, there may be provision for the positioning between the draw die and component to be set fixedly only when at least part of the component has passed into or beyond the centering region. The centering region preferably has a constant cross section, for example cylindrical. However, the centering region may also be of conical design. The centering region may also be ramp-shaped in one or more regions. In particular, the centering region may also be configured in the form of a chamfer angle. The centering region may also be at least partially ramp-shaped and partially provided with a constant diameter. Other configurations are also possible.

It has proved to be advantageous for the long-term resistance of the draw die if the latter is equipped with a wear-reducing coating. This wear-reducing coating may be applied, for example, by electroplating. In particular, the coating has a lower coefficient of friction than the material to which it is applied.

According to one embodiment, the draw die itself is manufactured at least partially from a sintered material. For example, the draw die may be of multipart construction. A first region is manufactured, for example, from sintered material. By contrast, a second region, which is fastened on or together with the first region, consists, for example, of steel. In particular, there may be provision for the draw die to have at least the toothing-forming region arranged so as to be exchangeable. According to a refinement, even a plurality of toothing-forming regions may in each case be exchanged separately from one another. For this purpose, the draw die has, for example, a basic body in which the toothing-forming regions are arranged, for example in the form of disks or the like. Furthermore, there is the possibility that the overall draw die is manufactured from a sintered material. The draw die may also be manufactured from a tool steel or from a hard metal.

According to a further idea of the invention, a toothing rolling tool for carrying out a method for manufacturing a toothing on a component of a shaft/hub connection is proposed, the component being held permanently in a chucking while it receives an at least two-stage toothing in this chucking. The toothing rolling tool has a toothing-forming first region with a first height and at least one toothing-forming second region with a second height which is arranged after the first region, the first height being lower than the at least second height. The toothing rolling tool is capable, by means of a rolling movement, of obtaining a displacement and, if appropriate, compression of the material of the component, the toothing-forming regions bringing about a material displacement, at the end of which the component has a ready-manufactured toothing. According to a first refinement, there is provision for the toothing rolling tool to be designed at least as a rolling wheel with a multistage toothing. However, the rolling wheel may also have a toothing in which a first toothing-forming region is arranged so as to be shifted from the second toothing-forming region, as seen in the circumferential direction.

According to another refinement, the toothing rolling tool used is a rolling bar with a multistage toothing. In this case, too, a shift of the toothing-forming regions may be carried out. Wear-resistant coatings may be employed in the rolling wheel and in the rolling bar.

The toothing rolling tool preferably consists of two rolling beams or two rolling wheels with an opposite direction of movement.

According to a further idea of the invention, a component of a shaft/hub connection with an at least two-stage toothing is proposed, a multiplicity of surfaces of the toothing, in each case with a first region and with a second region, in each case with a different height of the toothing, having in each case a machining line which is aligned continuously in a unitary manner and from which the respective surfaces of the regions have in each case the same distances. By the component being manufactured with permanent holding in a chucking during the manufacture of the toothing, it is possible to manufacture particularly dimensionally accurate components with multistage toothings. In addition to the quality of the toothing itself, the manufacture of the toothings in, in particular, one operation makes it possible to have a particularly high quality of dimensional accuracy and positional accuracy between the first region and the second region of the toothing. The machining line employed in this case represents the direction of translational movement which takes place relatively between component and tool. During a rotating movement, the accuracy of the geometry is obtained in that the first and second regions in each case oriented in one line do not have any shift with respect to one another. In particular, the component has a quality of characteristic number 6 and less. As regards possible configurations of the shaft/hub connection and its elements, reference is made, moreover, to U.S. Pat. No. 6,142,033 to which reference is made in full in this regard within the framework of this disclosure.

Moreover, there is the possibility, in a superposition of a translational and a rotational relative movement between the component and the toothing tool, of also being able to generate a helical or screw geometry or spiral geometry of the toothing. For this purpose, it may be sufficient that the tool has the corresponding geometry and the component permits elastic spinning (twisting) or the workpiece holder is designed rotatably.

BRIEF DESCRIPTION OF THE DRAWINGS

Further advantageous refinements and developments are specified in more detail in the following drawing description. However, the features illustrated in each case there are not restricted to the individual embodiments. On the contrary, these may be linked to other features arising from the drawing description and from the general description given above, so as to form further embodiments. In the drawing.

DETAILED DESCRIPTION OF THE PREFERRED EMBODIMENT

Figure 1:
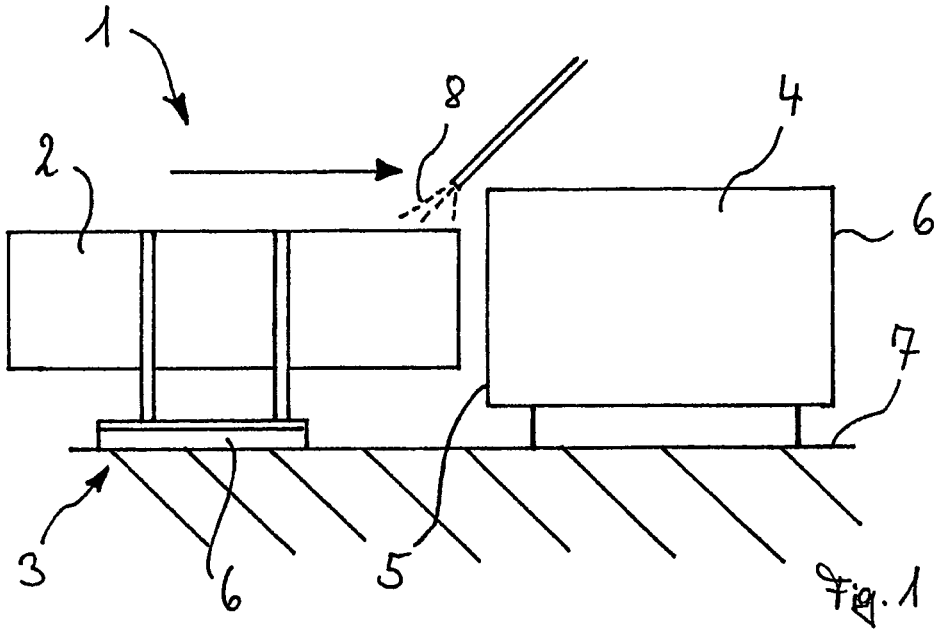
FIG. 1 shows a diagrammatic view of a first fixture for manufacturing a component of a shaft/hub connection with a toothing.

FIG. 1 shows a diagrammic view of a first fixture 1 for manufacturing a toothing on a component 2 of a shaft/hub connection, the component being held permanently in a chucking 3, while it receives an at least two-stage toothing in this chucking 3. For this purpose, the component 2 is moved into a draw die 4. For this purpose, the draw die 4 has in a first end face 5 an orifice in which toothing-forming regions extend longitudinally toward a second end face 6. For the advancing movement of the component 2, the chucking 3 is preferably connected to a guide device 26, for example a slide. The most diverse possible guide devices, chuckings, procedures, parameters and other apparatuses for manufacturing a toothing can be employed. In this regard, reference is made within the framework of this disclosure, for example, to the content of (U.S. Pat. No. 6,142,033) and that of FR 2 178 741 which are incorporated in full into this description. The guide device 26 and draw die 4 are arranged in a relatively adjustable relation to one another and allow an adjustable orientation of the component 2. Preferably, this is made possible via a surface 7. The latter serves at the same time as a surface for aligning the draw die 4, chucking 3 and component 2 in each case with one another. As indicated by the arrow, the component 2 is introduced into the draw die 4, an application of a toothing onto the component being assisted before and/or during the process via a lubricant supply 8 by means of the application of lubricant. The component 2 may have a preform which is preadapted, at least in one region, to the toothing to be manufactured later.

Figure 2:
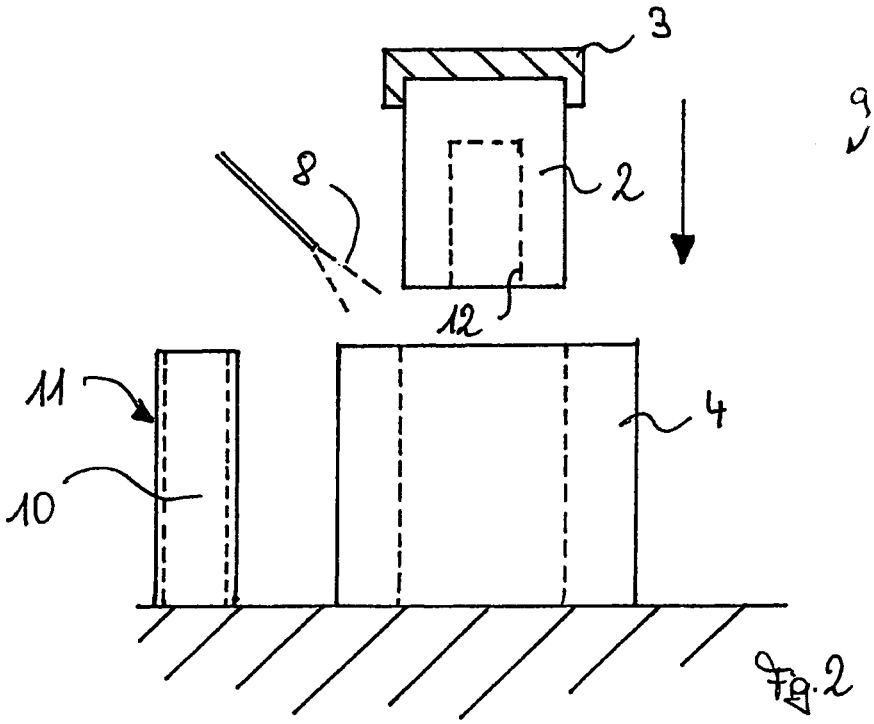
FIG. 2 shows a diagrammatic view of a second fixture for manufacturing a component of a shaft/hub connection with a toothing.

The same reference symbols are used below for identical or similar elements, without a restriction of the significances employed in each case being derivable from this. FIG. 2 shows a second fixture 9 in a diagrammatic view. In this case, the draw die 4 is oriented vertically. The component 2 in its chucking 3 is moved vertically via guides, not illustrated in any more detail, and is pressed into the draw die 4. In this case, lubricant may also be applied directly via the lubricant supply 8 to the toothing-forming regions which, indicated by dashes, are illustrated in the draw die 4. In addition to the draw die 4 with toothing-forming regions arranged inside it, a mandrel 10 is illustrated by way of example. The mandrel 10 has toothing-forming regions on the mandrel surface 11. The component 2 with an inner hollow region 12, which is indicated by dashes, may be guided over the mandrel 10 and pressed onto the latter. The mandrel surface 11 with the toothing-forming regions in this case displaces the material arranged in the hollow region 12, so that the toothing is formed.

Figure 3:
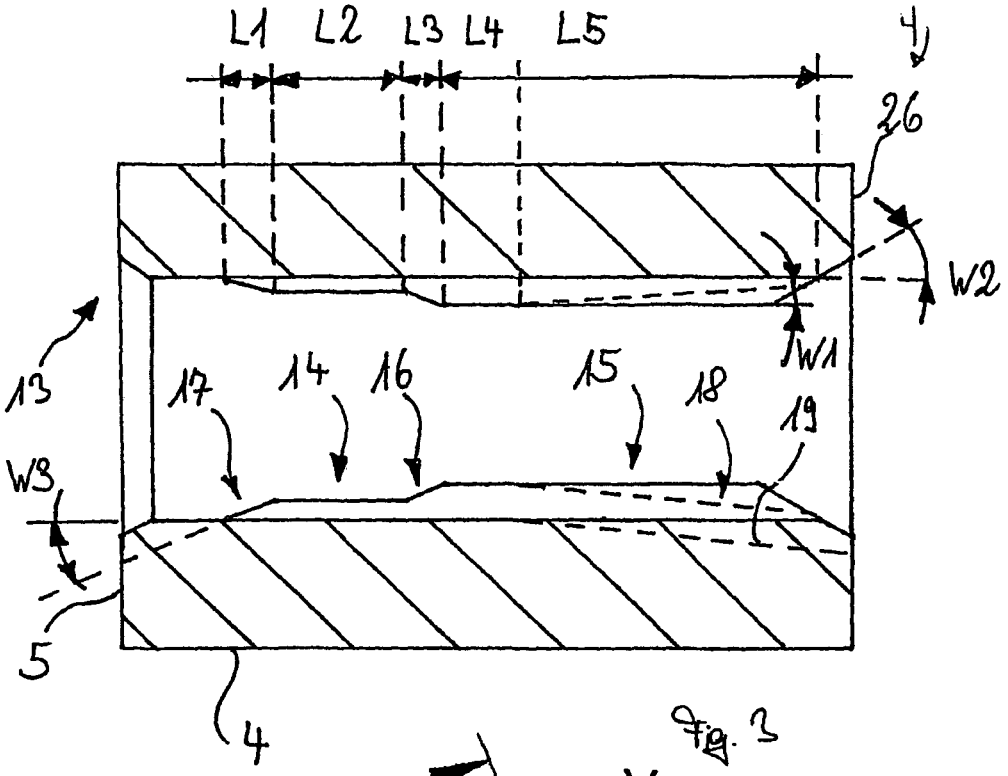
FIG. 3 shows a cross section through a draw die in a diagrammatic view.

FIG. 3 shows a first embodiment of the draw die 4 in an exemplary view. On the first end face 5, a centering region 13 is arranged. This is preferably designed as a chamfer and has a larger diameter than a component region to be toothed. In an interior of the draw die 4 are arranged a first toothing-forming region 14 and a second toothing-forming region 15. Between these two runs a ramp-like gradient 16 which transfers from the first toothing-forming region 14 to the second toothing-forming region 15. The first toothing-forming region 14 is preferably likewise preceded by a gradient 17. From the first end face 5 to the second end face 6, the draw die 4 is designed as a complete hollow body.

Preferably, a length L1 in relation to the toothing reference diameter D is selected in a ratio of $1.5<D/L1<60$. Advantageously, a ratio to the reference diameter D of $1.0<D/L2<20$ is provided for a length L2, and preferably a ratio to the reference diameter D of the toothing of $1.0<D/L3<60$ is provided for a length L3. According to an advantageous refinement, a length L4 is designed in relation to the reference diameter of the toothing within the limits $0.5<D/L4<70$. The second toothing-forming region 15 may have a length L5 in which the toothing merges into a countersink 18. This situation is illustrated by dashes for the countersunk region. The countersink may be designed, for example, as an undercut. An angle W1 between the countersink and the second toothing-forming region 15 is preferably such that a clearance angle is formed for the draw die. In this case, this is advantageous particularly when the component is at a fixed location and the draw die is guided moveably with respect to the component. A second angle W2 is preferably provided when the second toothing-forming region 15 projects directly up to the second end face 6. The countersink 18 then preferably runs out directly in the second end face 6. Contrary to the illustration, the countersink 18 may also be configured in such a way that a toothing bottom 19 is likewise countersunk. It is preferable if the length L4 of the second toothing-forming region 15 is designed within the limits specified above, and the length L5 is greater than the length L4 and the region L5, as illustrated by dashes as a countersink 18 and toothing bottom 19, runs toward the second end face 6. It is thereby possible to increase an inside diameter from the first end face 5 toward the second end face 6. This increase is accompanied by a possible stress relief of the compressed material of the component. There is therefore the possibility, with a knowledge of the behavior of the material of the component, of providing more pronounced displacement than is required according to the finished dimensions of the toothing of the component. The first and/or the second toothing-forming region may in each case be designed such that no remachining of the toothing on the component after machining by the draw die is necessary.

Figure 4:
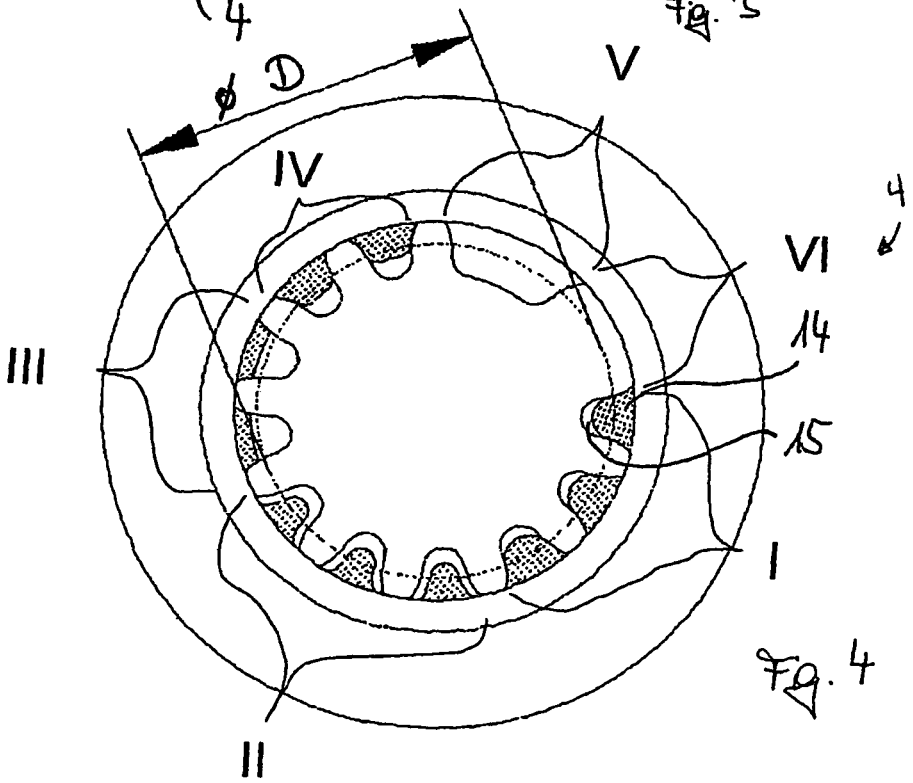
FIG. 4 shows a top view of the first end face of the draw die from FIG. 3.

FIG. 4 shows the first end face 5 of the draw die 4 in a diagrammatic view. Various possibilities of the first and second toothing-forming regions 14, 15 are illustrated, distributed over the inner circumference, in an exemplary illustration. For the sake of greater clarity, the surfaces of the first toothing-forming region 14 are filled with dots. A first region I has the first toothing-forming region 14 with a toothing contour which corresponds to that of the second toothing-forming region 15. In a second region II, the toothing-forming regions have essentially identical shapes, but different widths and heights. In a third region III, the toothings have essentially congruent flanks, but differ from one another in height. The height of the first region lies, here, below a reference diameter of the toothing, and a height line lies parallel to a reference circle of the toothing. In a fourth region IV, the toothings likewise have in the lower region essentially congruent flanks. Here, however, the height of the first region lies above the reference diameter of the toothing, and the height line lies in the toothing center, likewise parallel to the reference circle of the toothing. A transition between flank and height is rounded. In a fifth region V and in a sixth region VI, it is indicated that even portions in which no toothing is formed on the component may be provided. For example, for this purpose, a free surface may be formed, as illustrated in region V, or else a full surface, as illustrated in region VI. Furthermore, there is the possibility of causing the respective height to be different and of providing different flank gradients and/or different maximum widths. For example, the first toothing-forming region has a smaller maximum width than the following second toothing-forming region. In addition to very short flanks in the first region, the flanks may be drawn up very far, so that, in the following region, only a short region projects above them. The first and the second toothing-forming regions may also widen along their extent. This brings about a material displacement in the component not only in the vertical direction, but also in the horizontal direction.

Figure 5:
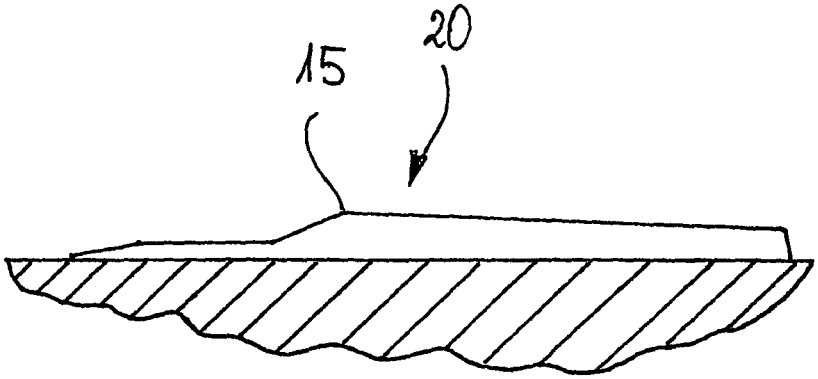
FIG. 5 shows a detail of a toothing of a draw die in a diagrammatic view.

FIG. 5 shows a detail of a tool 20, such as may be used, for example, as a mandrel or as a draw die. In this case, the second toothing-forming region 15 is summarized as an approximately punctiform elevation.

Figure 6:
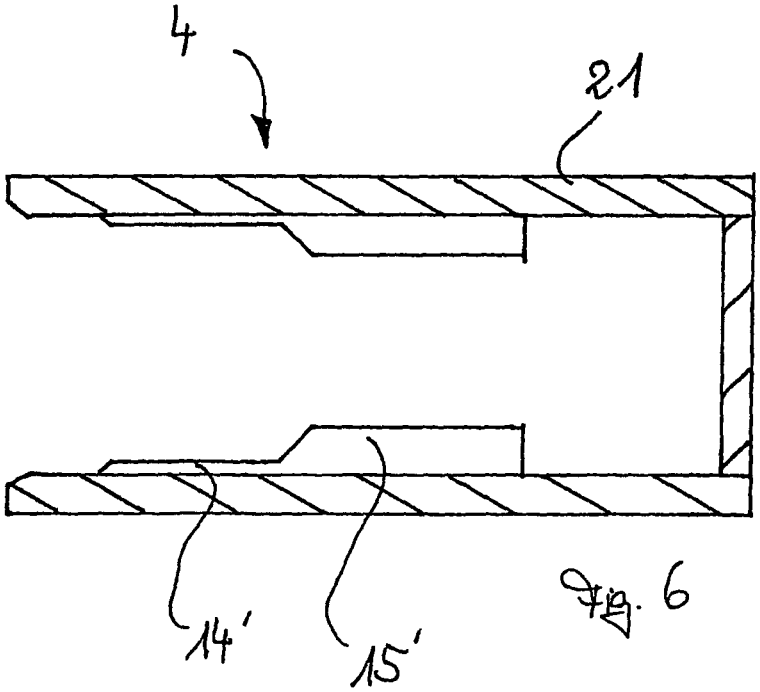
FIG. 6 shows a diagrammatic view of a further draw die.

FIG. 6 shows a further embodiment of the draw die 4 in a diagrammatic view. This has a closed-off second end face 6. For this purpose, the draw die 4 may consist of a plurality of constituents. In particular, the toothing-forming regions 14, 15 may also consist of a material other than that of a casing 21. For example, the toothing-forming regions 14, 15 can be used exchangeably in the casing 21.

Figure 7:
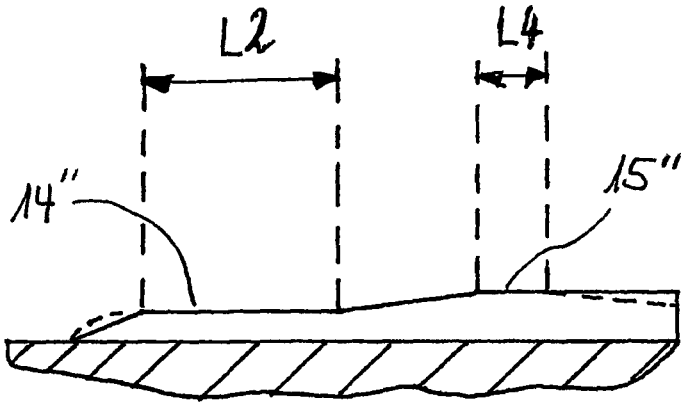
FIG. 7 shows a diagrammatic view of toothing-forming regions.

FIG. 7 shows a detail with a first and a second toothing region 14", 15", in which a rounded shape, as indicated by dashes, is used instead of a ramp running rectilinearly. The length L2 of the first toothing-forming region 14" is preferably longer by at least the factor 1.5 than the length L4 of the second toothing-forming region 15".

Figure 8:
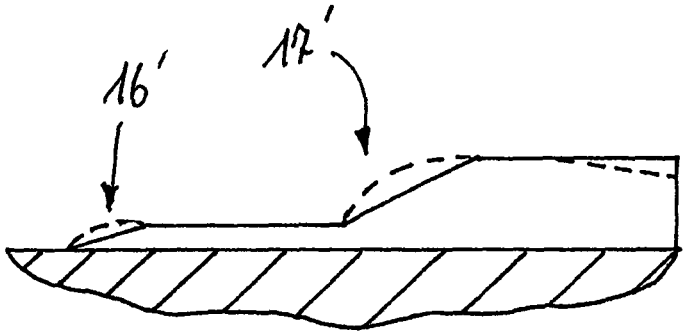
FIG. 8 shows a further diagrammatic view of toothing-forming regions.

FIG. 8 shows a further detail with toothing-forming regions. In this case, the gradient 17' and the gradient 16' may in each case be configured as rounded geometries. It has proved to be advantageous if the rounded contour is shaped at least partially according to a circle radius.

Figure 9:
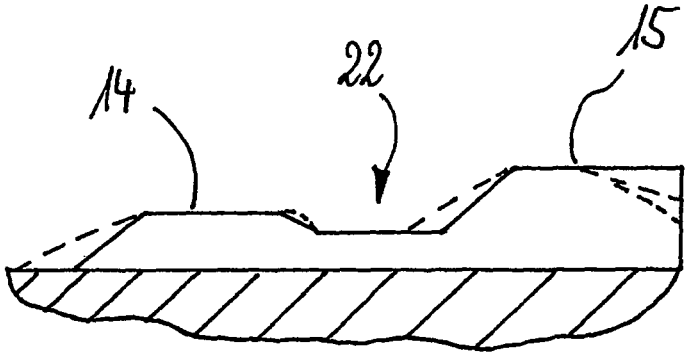
FIG. 9 shows another diagrammatic view of toothing-forming regions.

FIG. 9 shows an embodiment with toothing-forming regions, in which a depression 22 is arranged between the first 14 and the second toothing-forming regions. The depression 22 has a depth which allows a stress relief of the displaced material of the component before it comes into engagement with the second toothing-forming region 15. The depression 22 preferably has a length which is smaller than the length of the first toothing-forming region 14. As indicated, the respective gradients and countersinks may be at least partially of rectilinear, curved or else rounded design.

Figure 10:
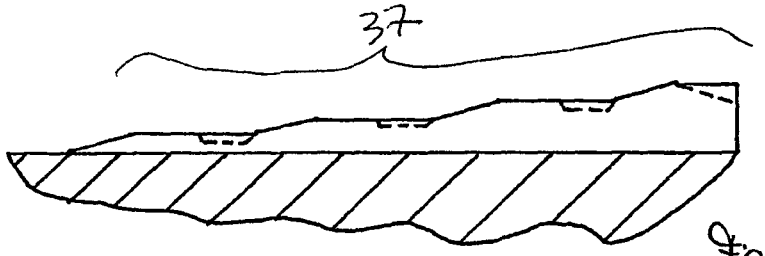
FIG. 10 shows an additional embodiment of toothing-forming regions in a diagrammatic view.

FIG. 10 shows a detail with a multiplicity of toothing-forming regions 37 arranged one behind the other. In this case, between the toothing-forming regions, in each case flanks of different steepness may be present, which may be rectilinear, circular or curved. Depressions may also be at least partially provided. These are indicated by dashes.

Figure 11:
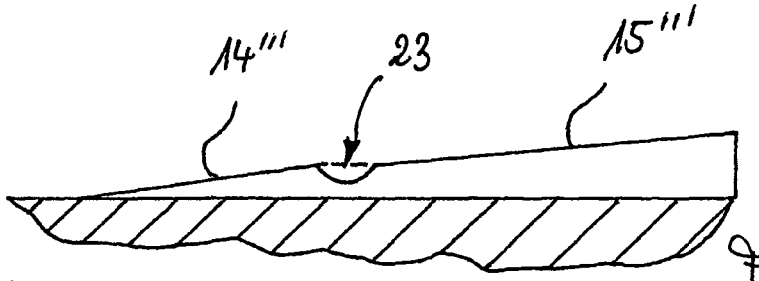
FIG. 11 shows another embodiment of toothing-forming regions of, for example, a draw die.

FIG. 11 shows a detail in which the first toothing-forming region 14''' and the second toothing-forming region 15''' are separated from one another by an undercut 23. The toothing-forming regions are formed in each case by ramp-like geometries which in each case may be provided with a unitary gradient or with gradients deviating from one another. The gradients may also change continuously along the regions.

Figure 12:
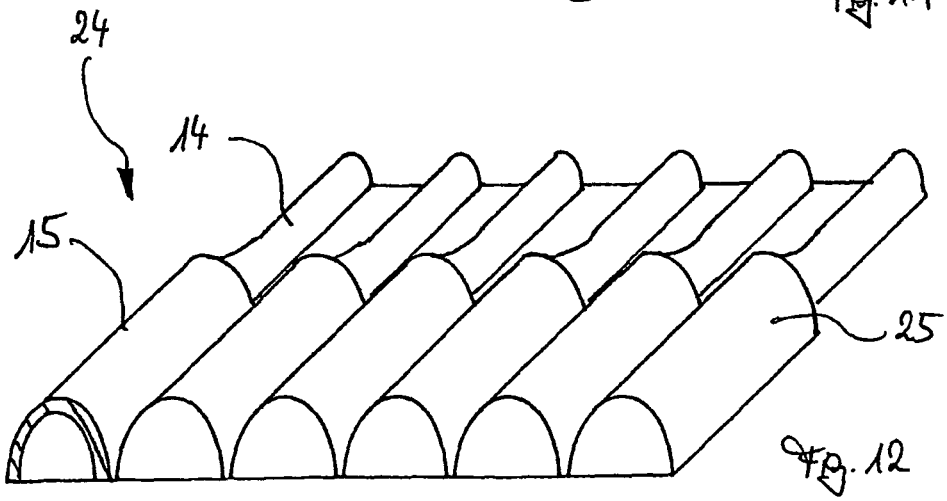
FIG. 12 shows a diagrammatic view of a rolling bar as a toothing rolling tool for manufacturing a multistage toothing.

FIG. 12 shows a diagrammatic view of a toothing rolling tool in the form of a rolling bar 24 with two toothing-forming regions 14, 15. The regions 14, 15 have, for example, a wear-resistant coating. The rolling bar is rolled over the component and at the same time displaces the material. According to a development, two rolling bars may be arranged so as to run opposite one another in parallel. As a result of a relative movement of the two rolling bars with respect to one another, the component arranged between them can receive its toothing.

Figure 13:
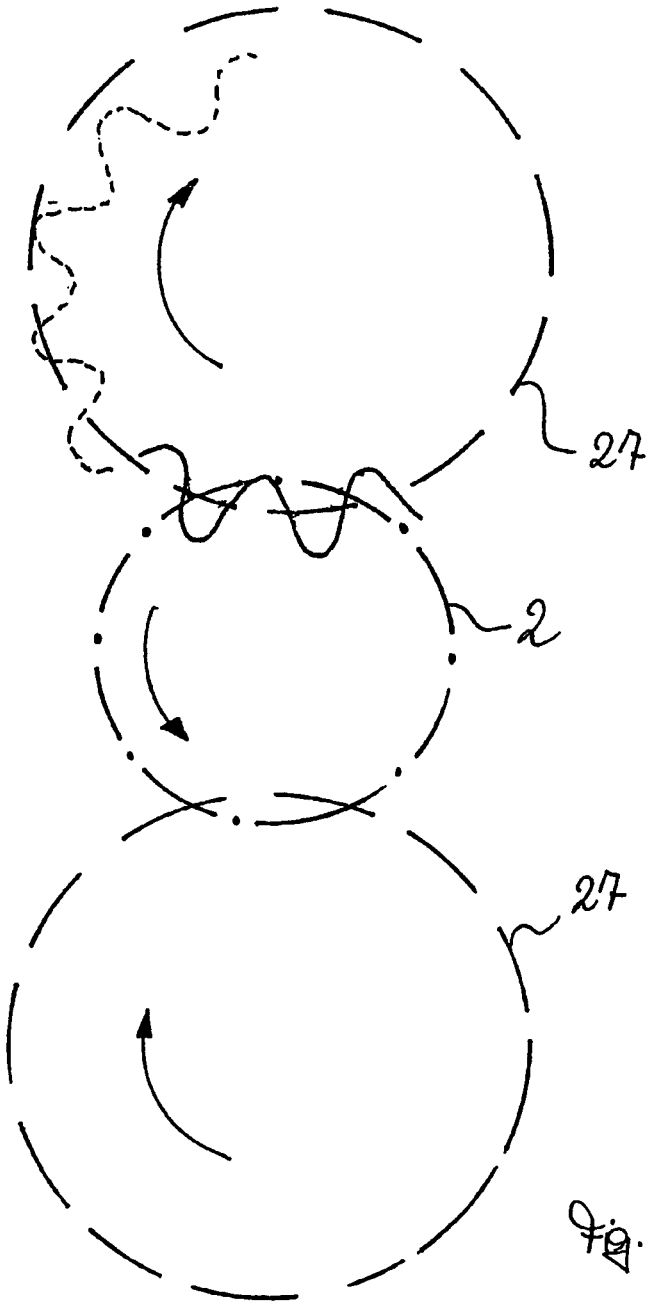
FIG. 13 shows a diagrammatic view of two rolling wheels for manufacturing a multistage toothing, between which rolling wheels a component is arranged.

FIG. 13 shows a diagrammatic view of a component 2 which is arranged between a first and a second toothing rolling tool in each case in the form of a rolling wheel 27 with a multistage toothing. As a result of a rotation of the rolling wheels 27 and an advancing movement of at least one of the two rolling wheels 27 in relation to the component 2, the toothing can be applied. According to another refinement, the toothing rolling tool has a continuous increase in the tooth height over its circumference. By means of rotation, this increasing tooth height is imparted to the component 2. The increasing tooth height is advantageously distributed approximately over the entire circumference. That is to say, in the case of rotation through 360°, the tooth height increases ever more. This is indicated by dashes by way of example. According to a development, it is not the entire circumference which is provided with an increasing tooth height. Instead, in one or more regions, no increase in the tooth height may be provided, but at least a constant tooth height. Preferably, a decrease in the tooth height is also present in one or more regions.

Figure 14:
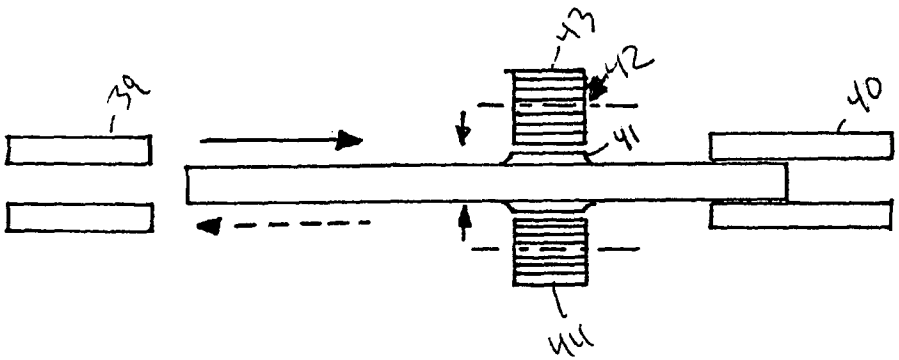
FIG. 14 shows a diagrammatic view of a fixture for toothing a shaft on both sides.

FIG. 14 shows a diagrammatic view of a fixture for toothing a shaft 38 on both sides. For example, an external toothing may be manufactured at each end of a shaft 38, that is to say, simultaneously, two external toothings (39, 40) in one chucking and, in particular, in one operation. In the case of a hollow shaft, for example, two internal toothings or else one internal and one external toothing may be manufactured simultaneously or with a slight time offset. Furthermore, for example, an elevated region 41, on which a toothing is likewise arranged, is arranged on the shaft, for example via a rolling tool 42, illustrated diagrammatically, with two rolling wheels (43, 44). The toothing may be a multistage toothing or a uniform toothing.

Figure 15:
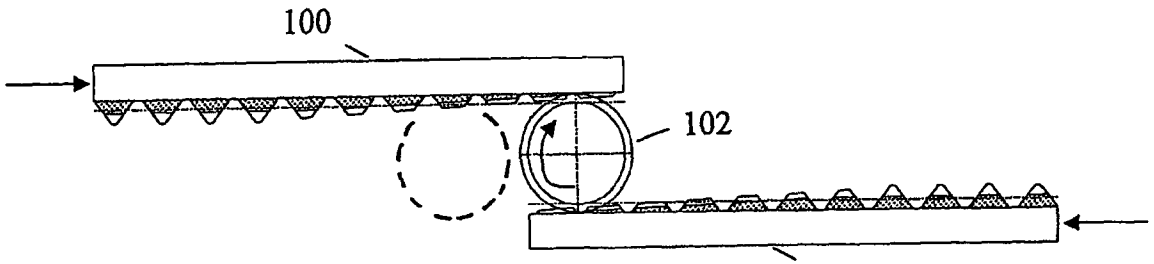
FIG. 15 shows a toothing tool in a diagrammatic view in the form of a rolling tool.

FIG. 15 shows a toothing tool in a diagrammatic view in the form of a rolling tool consisting essentially of a first rolling bar 100 and of a second rolling bar 101 as a rolling beam, in each case with a tooth height, increasing opposite to a direction of movement of the rolling bar, of at least the first and the second toothing-forming regions. The rolling bars 100, 101 have directions of movement opposite to one another. In particular, the rolling bars have a longitudinal extent and a width extent. A shaft 102 is set in rotation by the toothing tool and the toothing is formed into the shaft surface with an increasing feed. The shaft 102 is in this case held in its position by a centering device, not illustrated in any more detail. In addition to the machining of an individual shaft, there is the possibility of arranging a plurality of shafts next to one another and of machining these.

The invention claimed is:

1. A toothing rolling tool for manufacturing a toothing on a component of a shaft/hub connection, comprising: a chucking, wherein the component is held permanently in the chucking while it receives an at least two-stage toothing in the chucking in one operation, wherein the toothing rolling tool comprises, in the direction of a tooth length, a toothing-forming first region defining a first tooth height and a first tooth width and at least one toothing-forming second region defining a second tooth height and a second tooth width, wherein the second region is arranged after the first region in the direction of a tooth length, said first height being lower than said at least second height; wherein the first and second tooth width extend in a direction that is different than the tooth length.

2. The toothing rolling tool as claimed in claim 1, wherein the toothing rolling tool comprises at least one rolling wheel with a multistage toothing.

3. The toothing rolling tool as claimed in claim 2, wherein said toothing-forming first region is arranged so as the rolling wheel is to be shifted from said toothing-forming first region to said toothing-forming second region, in a circumferential direction.

4. The toothing rolling tool as claimed in claim 1, wherein the toothing rolling tool comprises at least one rolling bar with a multistage toothing.

5. The toothing rolling tool as claimed in claim 4, wherein said toothing-forming first region is arranged so as the rolling bar is to be shifted from said toothing-forming first region to said toothing-forming second region, in a circumferential direction.

6. The toothing rolling tool as claimed in claim 1, wherein said toothing rolling tool is configured to obtain a displacement by a rolling movement of the component, such that said toothing forming regions bring about a material displacement, at the end of which the component has a ready-manufactured toothing.

7. The toothing rolling tool as claimed in claim 6, wherein said toothing rolling tool is configured to obtain a compression of the material of the component by the rolling movement.

8. The toothing rolling tool as claimed in claim 1, wherein at least one of said regions has a wear-resistant coating.

* * * * *